US005651413A

United States Patent [19]

Williams et al.

[11] Patent Number: 5,651,413

[45] Date of Patent: Jul. 29, 1997

[54] IN-SITU CONDITIONING OF A STRIP CASTING ROLL

[75] Inventors: Robert S. Williams, Fairfield; Steven L. Campbell, Middletown, both of Ohio

[73] Assignee: Armco Inc., Middletown, Ohio

[21] Appl. No.: 540,371

[22] Filed: Oct. 6, 1995

[51] Int. Cl.[6] ..... B22D 11/06

[52] U.S. Cl. ..... 164/479; 164/121; 164/158; 164/428; 164/429; 164/480; 451/426

[58] Field of Search ..... 164/463, 472, 164/480, 72, 428, 268, 423, 429, 479, 121, 158; 451/49, 38, 426; 492/54, 58; 29/895.21, 895.1

[56] References Cited

U.S. PATENT DOCUMENTS

| | | | |
|---|---|---|---|
| 2,059,915 | 11/1936 | Ruch | 451/38 X |
| 2,204,636 | 6/1940 | Turnbull | 451/38 |
| 2,669,809 | 2/1954 | McGrath | 451/38 |
| 3,703,057 | 11/1972 | Krausz et al. | 451/38 X |
| 3,984,943 | 10/1976 | Kono et al. | 451/88 |
| 4,708,194 | 11/1987 | Mohn | 164/463 |
| 4,951,736 | 8/1990 | Yukumoto et al. | 164/428 |
| 5,103,895 | 4/1992 | Furuya et al. | 164/475 |

FOREIGN PATENT DOCUMENTS

| | | |
|---|---|---|
| 2-46952 | 2/1990 | Japan . |
| 5-177311 | 7/1993 | Japan . |
| 6-39501 | 2/1994 | Japan . |

*Primary Examiner*—J. Reed Batten, Jr.
*Attorney, Agent, or Firm*—R. J. Bunyard; L. A. Fillnow

[57] ABSTRACT

A strip caster (10) for producing a continuous strip (24) has a tundish (12) for containing a melt (14) and a pair of horizontally disposed water cooled casting rolls (22). The casting rolls are juxtaposed relative to one another for forming a pouring basin (18) for receiving the melt through a teeming tube (16) thereby establishing a meniscus (20) between the rolls for forming a strip (24). The melt is protected from the outside air by a non-oxidizing gas passed through a supply line (28) to a sealing chamber (26). Devices (29) for conditioning the outer peripheral chill surfaces of the casting rolls includes grit blasting nozzles (30A, 30B, 30C, 30D), a collection trough (32) for gathering the grit, a line (34) for recycling the grit to a bag house (36), a feeder (38) and a pressurized distributor (40) for delivering the grit to the nozzles. The conditioning nozzles remove dirt, metal oxides and surface imperfections providing a clean surface readily wetted by the melt.

13 Claims, 3 Drawing Sheets

IN-SITU CONDITIONING OF A STRIP CASTING ROLL

The Government of the United States of America has rights in this invention pursuant to Contract No. DE-FC07-92ID13086 awarded by the U.S. Department of Energy.

BACKGROUND OF THE INVENTION

This invention relates to a method and an apparatus for conditioning the chill surface of a strip casting roll. More particularly, the invention relates to cleaning the peripheral surface of the casting roll by in-situ grit blasting to remove dirt, metal oxides and surface imperfections that accumulate or form on the chill surface during casting of metal strip.

It is known to use brushes, buffers, grinders, flapper type devices and the like for conditioning the peripheral or circumferential surface of a casting roll used to solidify a metal melt into continuous metal strip. These mechanical conditioning devices may be ineffective for completely removing tightly adherent metal oxide. If metal oxide is not completely removed, the molten metal may not uniformly wet the roll chill surface and the solidified strip may not be adherent to the surface of the roll. These conditioning devices also tend to cut or otherwise mark the surface of the casting rolls. Scratch or grinding lines left on the surface tend to form surface defects on the strip. These conditioning devices also have a tendency to vibrate the casting roll which may affect the meniscus causing blemishes and cracks on the strip surface. These conditions also are undesirable because for strips having wide widths the devices must be segmented causing inhomogeneous surface conditions such as forming lines at the joints between the segments. These lines or seams may cause differences in the cast strip due to the effect on heat extraction. Also, there is a tendency to remove desirable surface finish of the casting roll.

Accordingly, there remains a need for removing metal oxides from the chill surface of a casting roll without leaving grinding lines or gouges. There also remains a need for conditioning the chill surface without vibrating the casting roll.

BRIEF SUMMARY OF THE INVENTION

A principal object of the invention is to remove metal oxide from the peripheral surface of a casting roll.

Other objects include improving wetting of molten metal to the surface of a casting roll thereby providing uniform strip adhesion across the width of the roll surface, elimination of surface defects to the strip surface, elimination of vibration to the casting roll, providing a uniform casting roll surface and maintaining a flat strip surface during casting.

The invention relates to conditioning the surface of a strip casting roll. The invention is for a method and an apparatus therefor for casting a metal melt into a continuous strip including providing a melt of the metal to be cast, providing a casting roll having a peripheral chill surface having a width at least as wide as the width of the strip, rotating the casting roll, blasting the entire width of the chill surface in-situ with grit for removing dirt, metal oxides, surface imperfections, and the like thereby providing a clean surface readily wetted by the melt, casting the melt onto the clean surface forming the continuous strip and removing the strip from the surface of the casting roll.

Another feature of the invention is to surround the cleaned roll surface with a non-oxidizing atmosphere and maintaining the cleaned surface in the non-oxidizing atmosphere until the dean surface is wetted by the melt.

Another feature of the invention includes providing a plurality of evenly spaced nozzles for jetting the grit against the chill surface of the casting roll.

Another feature of the invention includes providing means for traversing the nozzles across the full width of the chill surface.

Advantages of the invention include improved wetting of a metal melt to the peripheral surface of a casting roll, improved adhesion of the as-solidified strip to the roll surface, uniform adhesion across the width of the roll surface, elimination of vibration to the casting roll, elimination of surface defects on the surface of the as-cast strip, uniform cleaning of the chill surface of the casting roll and formation of a variety of surface finishes on the casting roll.

The above and other objects, features and advantages of the invention will become apparent upon consideration of the detailed description and appended drawings.

DETAILED DESCRIPTION OF THE PREFERRED EMBODIMENT

This invention relates to a method and an apparatus for in-situ conditioning the outer or peripheral chill surface of a casting roll by grit blasting. The chill surface is conditioned by removing dirt, metal oxides, surface imperfections and other non-uniformities that otherwise tend to accumulate or be formed on the chill surface during casting of metal strip. During casting, the chill surface of a casting roll will normally have a temperature of at least 300° C. When casting steel, the chill surface temperature may approach 600° C. At a temperature near 600° C., constituents contained in the melt such as aluminum, silicon and chromium tend to form oxides which tenaciously become adhered to the chill surface of the casting roll. These oxides decrease wetting of the molten metal to the chill surface and must be completely removed prior to contacting the melt to the casting roll. Impaired wetting of the melt to the casting roll can result in tearing of the strip and strip stickers. Various other defects to the strip surface such as blow holes can form from gases evolving when an oxide layer is permitted to buildup on the chill surface. Other problems associated with surface oxides include reduced thickness of the cast strip after heavy build up of oxide and retarding heat extraction from the strip.

The casting roll is water cooled and normally fabricated from a highly conductive metal such as copper. To enhance adherence of the as-cast strip to the surface of the roll and to improve heat and wear resistance of roll surface, the peripheral or chill surface of the roll may be electroplated with an oxide resistant coating having a thickness of about 0.2–1.0 mm such as nickel.

In this invention, by in-situ conditioning of the casting roll will be understood to mean cleaning of the roll surface during the strip casting operation. That is, the chill surface of the casting roll is cleaned on a continuous basis so that a clean surface is always available for the melt. By grit blasting will be understood to mean shot peening, bead blasting, jetting, toughening or cleaning of the outer or circumferential annular face of the casting roll by hard particulate type materials. Particles satisfactory for this purpose include such materials as alumina ($Al_2O_3$), iron oxide ($Fe_2O_3$) and glass beads ($SiO_2$). The continuous strip of the invention can be formed from a variety of ferrous and non-ferrous molten metals such as stainless steel, alloy steel, low carbon steel, aluminum and aluminum alloys, copper and copper alloys and amorphous metals.

Figure 1:
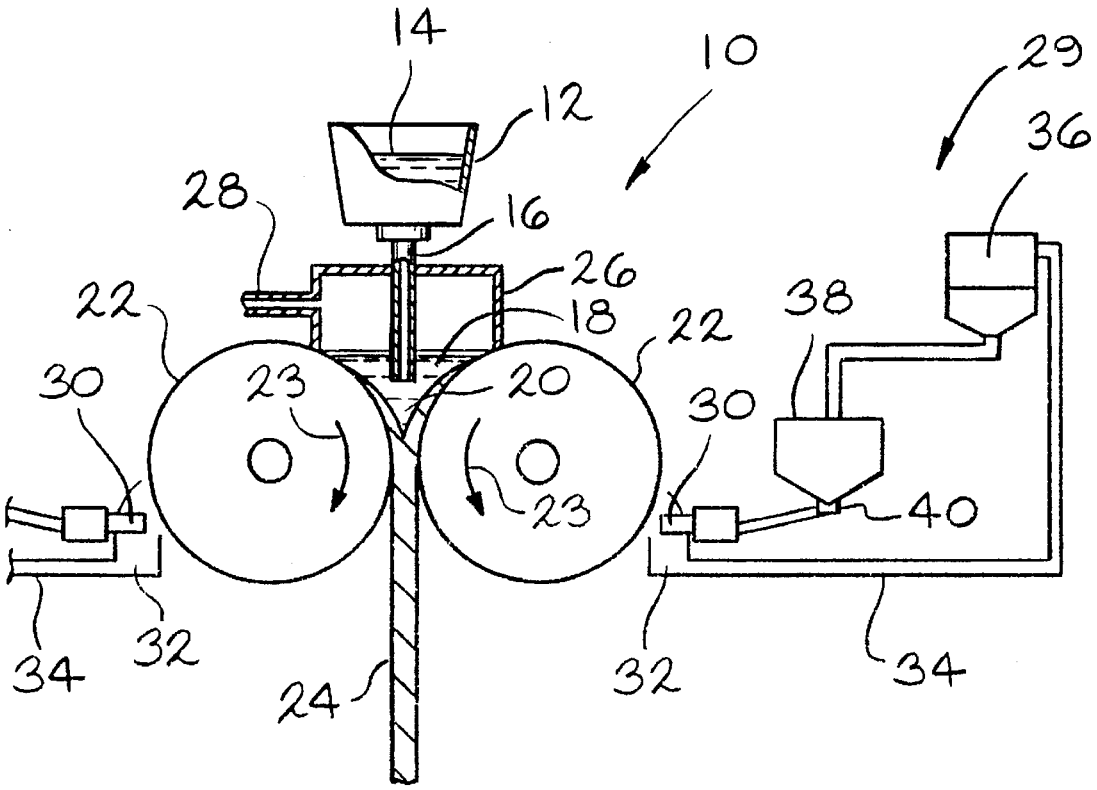
FIG. 1 is an elevation view, partially in section, of a twin roll strip caster incorporating the invention.

Referring to FIG. 1, reference numeral 10 denotes a caster for producing a continuous strip. Caster 10 includes a tundish 12 for containing a melt 14, a pair of horizontally disposed water cooled casting rolls 22 and means (not shown) for rotating rolls 22 toward one another as indicated by arrows 23. Casting rolls 22 are juxtaposed relative to one another for forming a pouring basin 18 for receiving melt 14 thereby establishing a meniscus 20 between the rolls. Melt 14 is delivered to pouring basin 18 through a teeming tube 16. As molten metal 20 is withdrawn from between rolls 22, a solidified strip 24 is formed. Preferably, melt 14 is protected from the outside air by a non-oxidizing gas within a sealing chamber 26 through a gas supply line 28. Suitable protective gas that may be used include nitrogen, argon, helium, hydrogen, carbon monoxide, carbon dioxide and ammonia. Means 29 for conditioning the outer peripheral chill surfaces of casting rolls 22 includes one or more grit blasting nozzles 30, a collection trough 32 for gathering the grit after impacting the chill surface of the casting roll, a line 34 for recycling the grit to a bag house 36, a feeder 38 and a pressurized distributor 40 for delivering the grit to nozzle 30. It may be desirable to have more than one bag house for storing more than one type grit. For example, a second type grit may be used to provide a different type texture finish to the chill surface of the casting roll.

The type strip caster illustrated in FIG. 1 is commonly referred to a twin roll or dual drum caster. It will be understood conditioning means 29 of the invention also could be used with a single roll caster as well. Unlike the twin roll caster of FIG. 1 wherein the strip is withdrawn from below an opposing pair of rolls, a strip is formed by being pulled over the top of the casting roll in a single roll caster.

Figure 2:
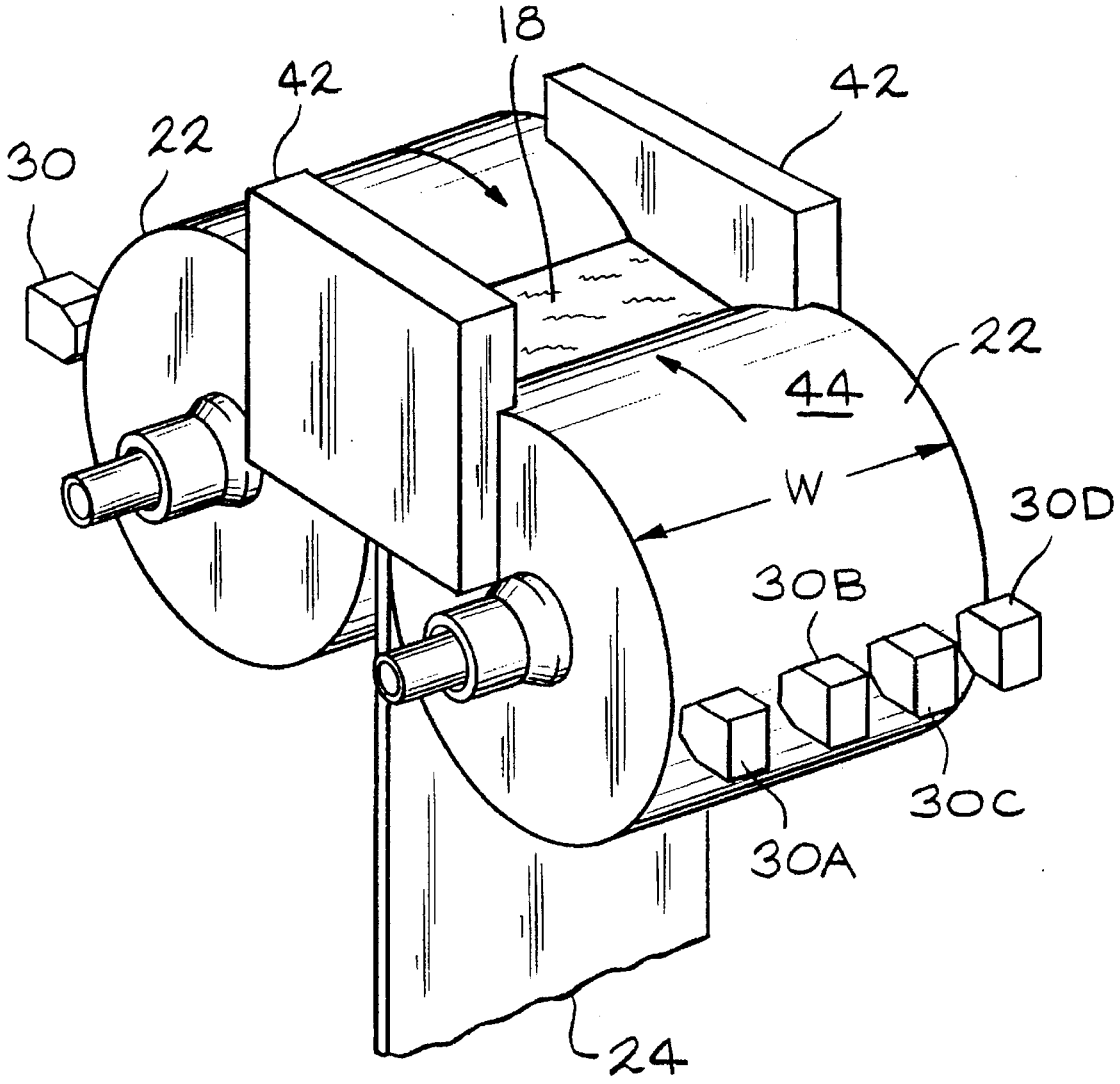
FIG. 2 is an enlarged perspective view of means for conditioning the chill surface of the casting roll illustrated in FIG. 1.

FIG. 2 is an enlarged view of the caster with sealing chamber 26 removed. Pouring basin 18 is formed between the meniscus between rolls 22 by a pair of side dams 42. In the embodiment illustrated, the conditioning means includes one row of four nozzles 30A, 30B, 30C and 30D evenly spaced from one another and positioned a short distance away from a chill surface 44 of each casting roll 22. Nozzles 30A, 30B, 30C and 30D are evenly spaced across the entire width W of chill surface 44 to uniformly and completely clean the entire width. It may be desirable to provide more than one row of the nozzles to even out any cleaning irregularity by the cleaning action of the nozzles.

Figure 3:
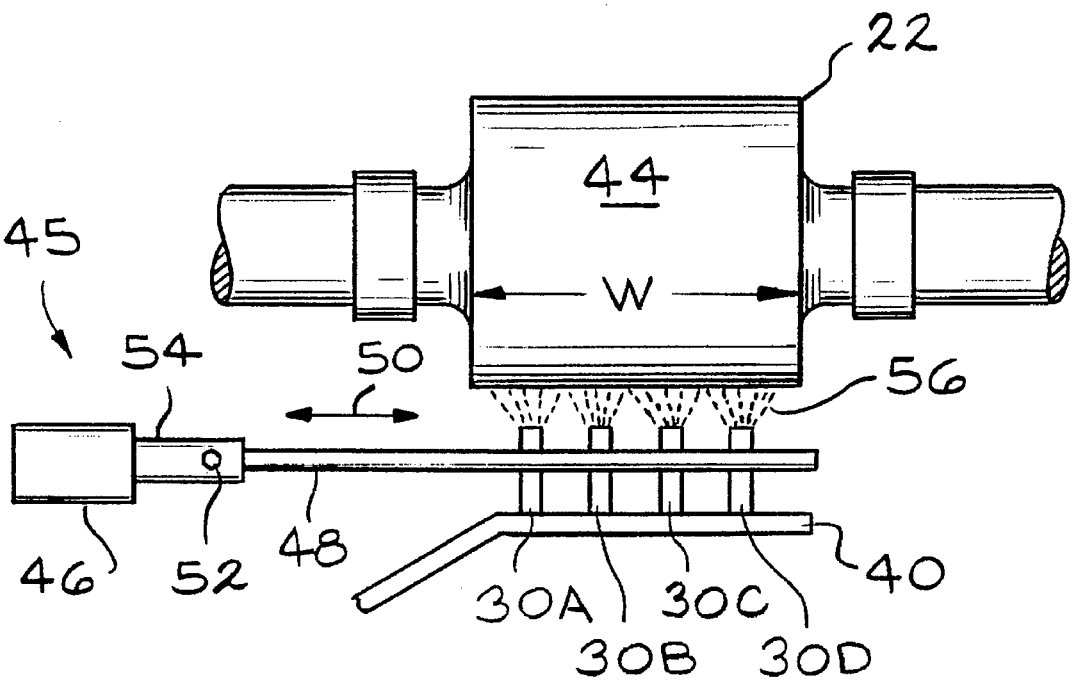
FIG. 3 is a top view illustrating details of the conditioning means of FIG. 2.

FIG. 3 is an enlarged view illustrating the spacing of nozzles 30A, 30B, 30C and 30D between each other and chill surface 44 of casting roll 22. In this embodiment, distributor 40 includes means 45 for traversing nozzles 30A, 30B, 30C and 30D across the width W of chill surface 44. Traversing means 45 includes an air cylinder 46, a piston 54 and a traversing arm 48 connected to the piston by a bolt 52. Nozzles 30A, 30B, 30C and 30D are mounted onto traversing arm 48. Traversing means 45 allows the nozzles to oscillate in a direction indicated by an arrow 50 to insure complete and uniform cleaning by grit 56 of dirt, metal oxides, surface imperfections and any non-uniformities that may occur on chill surface 44 of casting roll 22. Traversing means 45 also tends to even out any irregularity in the cleaning action of the nozzles.

In addition to protecting the melt from atmospheric oxidation, it also may be desirable to protect cleaned surface 44 of roll 22 from oxidation from the outside air as well, particularly when casting metals such as steel. When casting steel, the chill surface temperature of the casting roll typically approaches 600° C. At this temperature, the chill surface may re-oxidize prior to being contacted by the melt thereby diminishing adhesion of the steel strip to the chill surface. In this case, it may be desirable to surround the cleaned portion of the casting roll with a non-oxidizing atmosphere similar to those recommended for sealing chamber 26. The clean chill surface would be protected by the non-oxidizing gas until the clean surface is rotated to and becomes covered by the melt pool in the pouring basin.

It will be understood various modifications may be made to the invention without departing from the spirit and scope of it. Therefore, the limits of the invention should be determined from the appended claims.

What is claimed is:

1. A method of casting metal into a continuous strip, comprising:

providing a melt of a metal to be cast, providing a casting roll having a peripheral chill surface having a width at least as wide as the width of the strip and a plurality of nozzles uniformly spaced adjacent to and across the width of the chill surface, rotating the casting roll, blasting the entire width of the chill surface in-situ with grit from the nozzles for removing dirt, metal oxides, and surface imperfections thereby providing a clean chill surface readily wetted by the melt, casting the melt onto the clean chill surface forming the continuous strip, and removing the strip from the chill surface of the casting roll.

2. The method of claim 1 including the additional steps of:

surrounding the clean surface with a non-oxidizing atmosphere, maintaining the clean surface in the non-oxidizing atmosphere until the clean surface is wetted by the melt.

3. The method of claim 1 including a plurality of rolls for casting the strip.

4. The method of claim 1 wherein the grit is from the group consisting of $Al_2O_3$, $SiO_2$ and $Fe_2O_3$.

5. A method of casting metal into a continuous strip, comprising:

providing a melt of a metal to be cast, providing a pair of juxtaposed casting rolls for forming a pouring basin, each roll having a peripheral chill surface having a width at least as wide as the width of the strip and a plurality of nozzles uniformly spaced adjacent to and across the width of the chill surface, rotating the rolls in a direction toward one another, blasting the entire width of the chill surface of each roll in-situ with grit for removing dirt, metal oxides, and surface imperfections thereby providing a clean chill surface on each roll readily wetted by the melt, coating the entire chill surface of each of the rolls with an oxide resistant coating having a thickness of about 0.2–1.0 mm, casting a pool of the melt into the pouring basin with the clean chill surfaces forming the continuous strip there between, and withdrawing the strip from the chill surfaces of the casting rolls.

6. In an apparatus for casting metal into a continuous strip, comprising:

a horizontally positioned casting roll having a peripheral chill surface having a width at least as wide as the width of the strip, means for conditioning the entire width of the chill surface with grit for removing dirt, metal oxides, and surface imperfections, means for traversing the conditioning means across the width of the chill surface thereby providing a clean chill surface on the roll, means for recycling the grit and a distributor for delivering the grit to the conditioning means.

7. The apparatus of claim 6 wherein the conditioning means includes a nozzle.

8. The apparatus of claim 6 wherein the conditioning means includes a plurality of evenly spaced nozzles.

9. The apparatus of claim 8 wherein the nozzles are positioned within one row.

10. The apparatus of claim 8 wherein the nozzles are positioned in a plurality of rows.

11. The apparatus of claim 7 wherein the traversing means is an air cylinder for oscillating the nozzle across the width of the chill surface.

12. The apparatus of claim 6 including a pair of casting rolls, each roll including the conditioning means positioned adjacent to the chill surface.

13. The apparatus of claim 6 wherein the chill surface of the roll is covered with an oxide resistant coating having a thickness of about 0.2–1.0 mm.

* * * * *